US006158588A

United States Patent [19]

Conti

[11] Patent Number: 6,158,588

[45] Date of Patent: Dec. 12, 2000

[54] GIFT PACKAGE

[76] Inventor: Jeff S. Conti, 1342 Willow Ct., Schererville, Lake County, Ind. 46375

[21] Appl. No.: 09/333,361

[22] Filed: Jun. 15, 1999

Related U.S. Application Data

[60] Provisional application No. 60/089,393, Jun. 15, 1998.

[51] Int. Cl.[7] ..... B65D 55/00

[52] U.S. Cl. ..... 206/457; 206/459.1; 116/307

[58] Field of Search ..... 206/751, 754, 206/459.1, 457, 472, 473; 116/307, DIG. 1, DIG. 8, DIG. 9, 306

[56] References Cited

U.S. PATENT DOCUMENTS 4,467,920 8/1984 Smith ..... 206/457
5,056,681 10/1991 Howes ..... 206/457
5,283,567 2/1994 Howes ..... 206/457

*Primary Examiner*—Jacob K. Ackun
*Attorney, Agent, or Firm*—Gary M. Hartman; Domenica N. S. Hartman

[57] ABSTRACT

A gift product package that allows a gift giver to easily order and have delivered a personalized gift. The package is adapted for delivery such as by courier, and presents the gift and special effects in a lively and potentially personalized manner. The package generally entails a rugged exterior carton for shipping purposes, a disguised container for concealing a gift, a recordable sound module which allows a gift giver to record a personalized message that is played upon opening the container, and an inflation device that causes a small gas canister to fill a large balloon or eject confetti. In addition to these special effects, the container is also configured to contain other party favors and a gift card.

12 Claims, 3 Drawing Sheets

GIFT PACKAGE

CROSS REFERENCE TO RELATED APPLICATIONS

This application claims the benefit of U.S. Provisional application No. 60/089,393, filed Jun. 15, 1998.

BACKGROUND OF THE INVENTION

1. Field of the Invention

The present invention generally relates to gift products. More particularly, this invention relates to a gift package that creates a virtual party atmosphere when the package is opened.

2. Description of the Prior Art

With much of the general population having busy lives, it has become more difficult to find time to shop for special gifts. The world of today depends on products and technologies that, while making life easier, can lessen the personal touch that brings genuine warm feelings and good tidings between the gift giver and receiver. Few gift products exist which can communicate these special feelings, and those that do are often inconvenient.

SUMMARY OF THE INVENTION

According to the present invention, there is provided a gift product package that allows a gift giver to easily give a special personalized gift to create a lasting impression on the recipient. An object of the present invention is to permit a gift giver to select various offered options for gifts and special effects options, which are then assembled to yield a customized gift product package. The package is adapted for delivery such as by courier, and presents the gift and special effects in a lively and potentially personalized manner. To achieve these features, the package generally entails a rugged exterior carton for shipping purposes, a disguised container configured to conceal one or more gifts, a recordable sound module which allows a gift giver to record a personalized message or select a prerecorded greeting or music that is played upon opening the container, and an inflation device that causes a small gas canister to fill a large balloon or eject confetti. In addition to these special effects, the container is also configured to contain other party favors and a gift/greeting card.

An advantage of this invention is that of convenience combined with originality, by which a gift recipient is able to experience a personalized and eventful gift that can be easily purchased, assembled and delivered from a location remote to the sender. Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
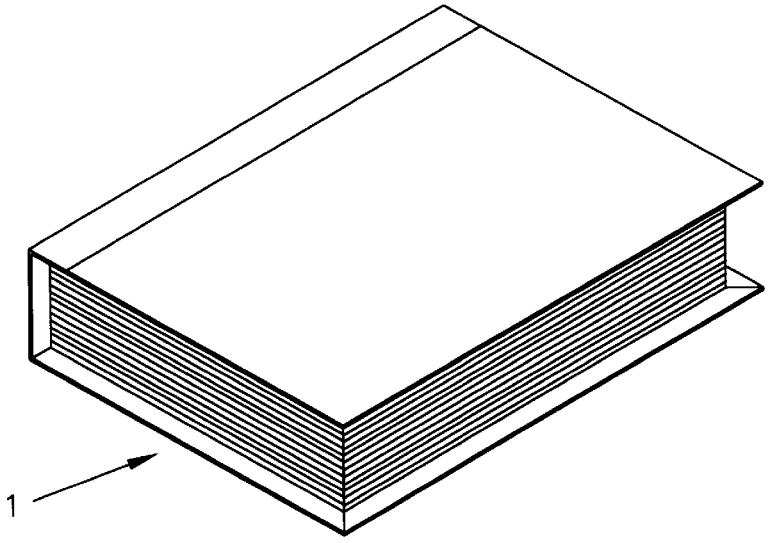
FIG. 1 is a perspective view of a closed partybook gift product in accordance with a preferred embodiment this invention.
Figure 2:
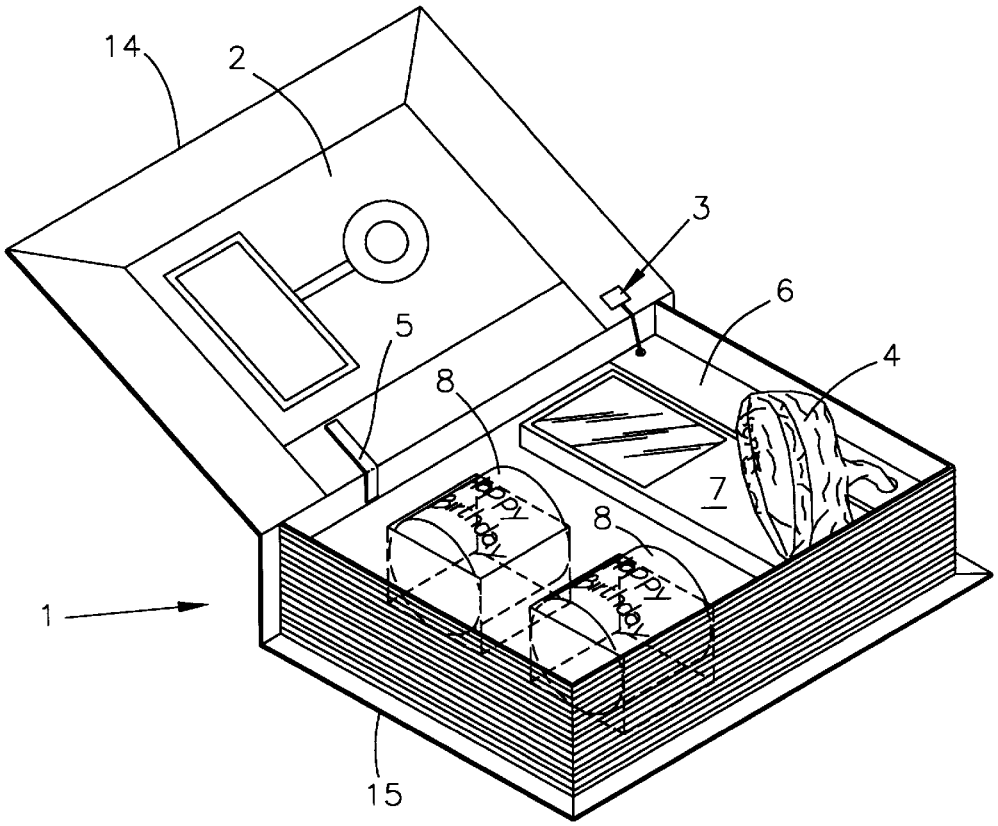
FIG. 2 is a perspective view of the gift product of FIG. 1 immediately on being opened.

Referring to FIG. 1, the invention is shown as a closed gift package 1 shaped to resemble a book. For delivery, the package 1 is preferably enclosed within a plain fluted shipping container to disguise its contents. FIG. 2 shows the contents of the gift package 1 as they are preferably housed within the package 1 in accordance with a preferred embodiment of the invention. A sound module device 2 of a type known and commercially available is shown attached to the lid 14 of the package 1 and is triggered to play a recorded message 13 and/or music 12 by a pull-tab activation switch 5 that is attached to the main body 15 of the package 1. The recorded message 13 can be made by the sender of the package 1 when phoning in the order for the package 1, which includes selecting the particular style for the package 1 and the gifts to be included in the package 1. Alternatively, the recorded message 13 can be a prerecorded greeting and/or music selected by the sender when ordering the package 1.

Figure 3:
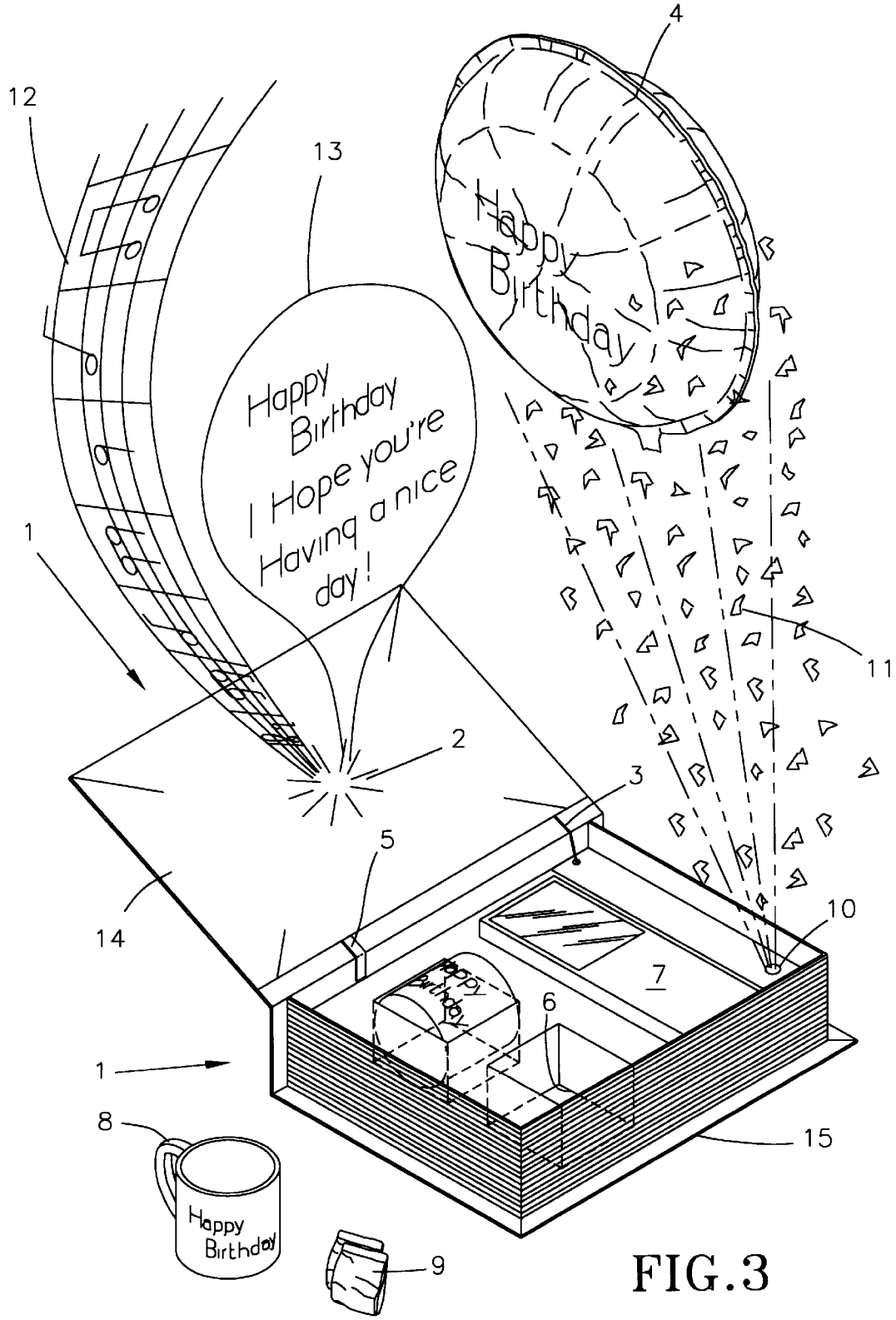
FIG. 3 is a perspective view of the gift product of FIGS. 1 and 2 after the special effects have been deployed, including the inflation of a balloon, the release of confetti and the playing of a recorded message from a sound module.
Figure 4:
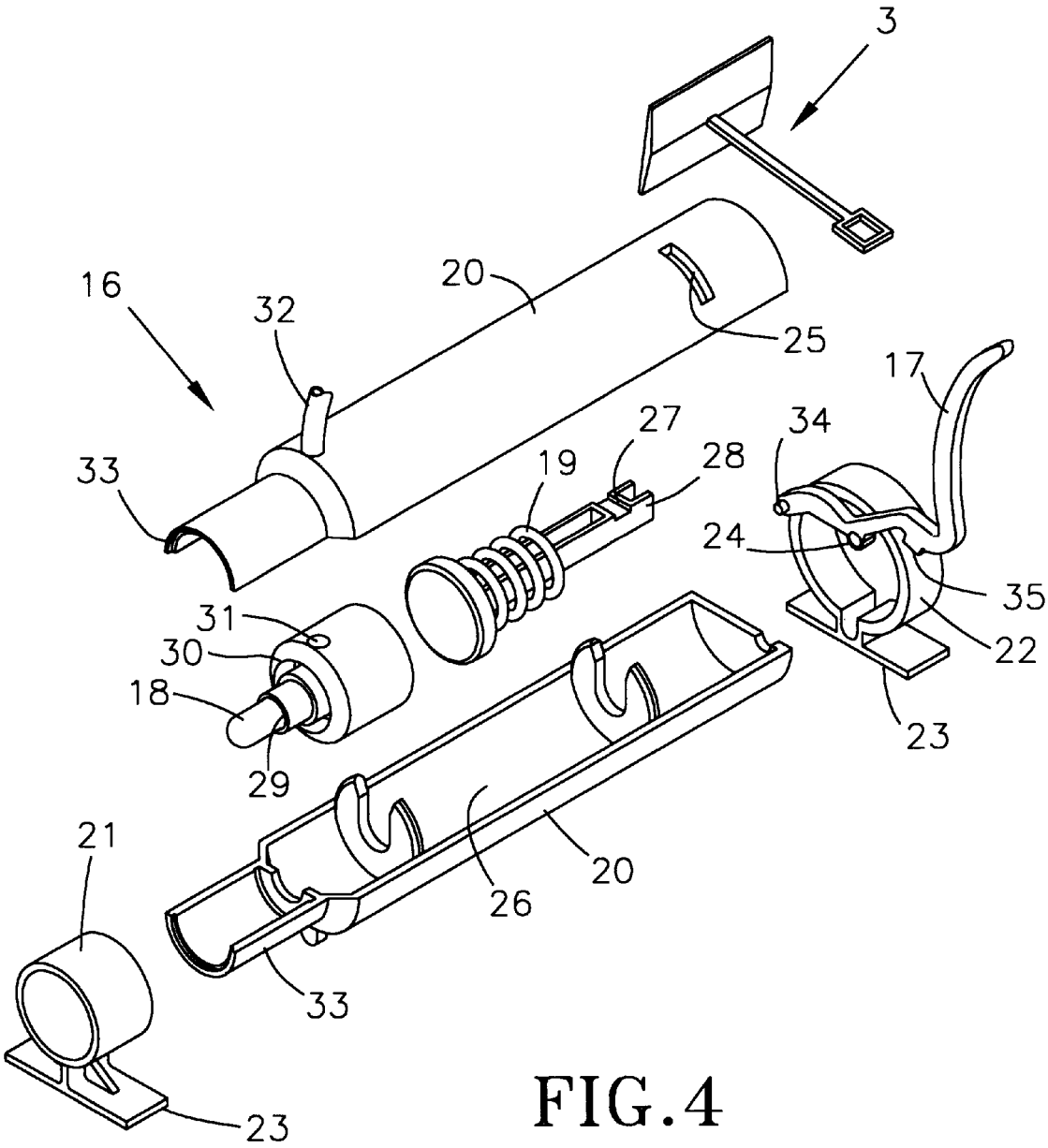
FIG. 4 is an exploded view of an inflation device for automatically inflating the balloon or ejecting confetti on opening the gift product.

In FIG. 2, a folded balloon 4 is shown mounted to a concealed inflation device 16 (shown in detail in FIG. 4) through a port hole 10 that is visible in FIG. 3. Inflation of the balloon 4 is initiated by a pull latch 3 attached to the lid 14 of the package 1. With reference to FIG. 4, the other end of the pull latch 3 is attached to a lever 17 of the inflation device 16, which is adapted to purge a gas cylinder (not shown) that fills the balloon 4. The inflation device 16 is preferably an assembly of plastic injection-molded components, a pin 18 and a spring 19. The inflation device 16 is shown as being composed of a housing 20 formed by a pair of housing halves held together by front and rear collars 21 and 22, respectively. The collars 21 and 22 include feet 23 that facilitate mounting and attaching the device 16 within the package 1. The lever 17 is pivotally attached to the housing 20 with a pair of pins 34 (one of which is visible), and extends out of the housing 20 through a slot 25. A tab 35 on the lever 17 engages a notch 27 formed in an actuating plunger 28 reciprocally received in a main body channel 26 of the housing 20. The lever 17 also has an annular-shaped tab 24 by which the lever 17 can be secured with a pin (not shown) while the tab 35 is engaged in the notch 27, thereby preventing unintentional actuation of the lever 17 (and deployment of the inflation device 16, as explained below).

When actuated by the pull latch 3, the tab 35 on the lever 17 releases the plunger 28, which is biased toward the front collar 21 by the spring 19, which is preferably a compressed steel coil spring 19. The plunger 28 then moves rapidly forward (leftward in FIG. 4) through the channel 26 until it impacts the pin 18, forcing the pin 18 through a central bore 29 of an annular-shaped seal/guide 30 and into a gas cylinder threaded to a portion 33 of the housing 20 surrounded and reinforced by the front collar 21. While various gas cylinders could be used, a commercially-available 38 gram $CO_2$ cylinder is preferred.

Once punctured by the pin 18, the cylinder releases pressurized gas around the pin 18 and into the seal/guide 30, which redirects the gas through a side port 31 into a hose 32 with an opposite end inserted and secured within the neck of the balloon 4, preferably a self-sealing MYLAR balloon. Alternatively, the hose 28 could be attached to a confetti tube (not shown) for ejection of confetti. As shown in FIG. 3, as the balloon 4 inflates and rises, it preferably releases confetti 11 loosely held within its folds. FIG. 3 also shows selected themed gifts 7, 8 and 9 contained and secured within inserts 6 within the main body 15 of the package 1 to prevent damage during shipping.

While the invention has been described in terms of a preferred embodiment, it is apparent that other forms could be adopted by one skilled in the art. For example, the structure, materials, sizes and shapes of the individual components and package could be modified, and appropriate materials could be substituted for those noted. Accordingly, the scope of the invention is to be limited only by the following claims.

What is claimed is:

1. A gift package comprising:

a container having a lid;

at least one gift stored within the container;

means for activating a sound recording when the container is opened by moving the lid; and means for activating special effects when the container is opened by moving the lid.

2. A device according to claim 1, wherein the gifts are concealed within the container by the lid.

3. A device according to claim 1, wherein the container is disguised as a book and the lid is disguised as a cover to the book.

4. A device according to claim 1, wherein the special effects are chosen from the group consisting of balloons and confetti.

5. A device according to claim 1, wherein the special effects-activating means is a gas-releasing device.

6. A device according to claim 1, wherein the special effects comprises a balloon and the special effects-activating means comprises an inflation device for inflating the balloon.

7. A device according to claim 6, wherein the inflation device comprises:

a latch actuated by the lid;

a plunger configured to be released by the latch under a biasing force;

a pin configured to be impacted by the plunger so as to pierce a chamber containing a pressurized gas; and a member associated with the pin for venting the gas to the balloon.

8. A device according to claim 7, further comprising a housing in which the plunger, the pin and the member are coaxially located.

9. A device according to claim 7, wherein the member is an annular-shaped member that guides the pin and forms a substantially gas-tight seal with the pin after the pin pierces the chamber.

10. A device according to claim 6, wherein the special effects further comprises confetti that is ejected when the balloon is inflated.

11. A gift package comprising:

a container having a lid, the container being disguised as a book and the lid being disguised as a cover to the book;

at least one gift concealed within the container by the lid;

means for activating a sound recording when the container is opened by moving the lid; and gas-charged means for activating special effects when the container is opened by moving the lid, the gas-charged means comprising an inflation device for inflating a balloon.

12. A device according to claim 11, wherein the inflation device comprises:

a latch actuated by the lid;

a lever engaged by the latch;

a housing to which the lever is pivotally connected, the housing having a chamber;

a plunger within the chamber and configured to be released by the lever under a biasing force;

an annular-shaped member coaxially aligned with the plunger within the chamber, the annular-shaped member having a central bore and a radial port; and a pin reciprocally received within the central bore of the annular-shaped member, the pin being aligned for impact by the plunger so as to pierce a chamber containing a pressurized gas, the pin being received within the central bore of the annular-shaped member so that the gas flows around the pin and is vented from the housing through the radial port in the annular-shaped member.

* * * * *